US008754822B1

(12) United States Patent
Dou

(10) Patent No.: US 8,754,822 B1
(45) Date of Patent: Jun. 17, 2014

(54) TUNING ELEMENTS FOR SPECIFIC ABSORPTION RATE REDUCTION

(75) Inventor: Weiping Dou, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 782 days.

(21) Appl. No.: 12/857,987

(22) Filed: Aug. 17, 2010

(51) Int. Cl.
*H01Q 13/10* (2006.01)
*H01Q 1/24* (2006.01)
*H01Q 19/00* (2006.01)

(52) U.S. Cl.
USPC ..... 343/767; 343/702; 343/833

(58) Field of Classification Search
USPC ..... 343/702, 767, 770, 833
See application file for complete search history.

(56) References Cited

U.S. PATENT DOCUMENTS

| | | | | |
|---|---|---|---|---|
| 6,404,394 | B1 * | 6/2002 | Hill | 343/700 MS |
| 7,057,569 | B2 * | 6/2006 | Isoifovich et al. | 343/770 |
| 7,132,992 | B2 * | 11/2006 | Mori | 343/770 |
| 7,343,183 | B2 * | 3/2008 | Iguchi | 455/575.7 |
| 7,576,699 | B2 | 8/2009 | Gilmore et al. | |
| 7,764,236 | B2 * | 7/2010 | Hill et al. | 343/702 |
| 2004/0113849 | A1 * | 6/2004 | Jarmuszewski et al. | 343/702 |
| 2004/0130492 | A1 | 7/2004 | Egawa et al. | |
| 2006/0170599 | A1 | 8/2006 | Gilmore et al. | |
| 2007/0159404 | A1 | 7/2007 | Gilmore et al. | |
| 2009/0270146 | A1 | 10/2009 | Hirai | |

* cited by examiner

*Primary Examiner* — Michael C Wimer
*Assistant Examiner* — Hasan Islam
(74) *Attorney, Agent, or Firm* — Lowenstein Sandler LLP

(57) ABSTRACT

A user device having a multi-band slot antenna with multiple slot openings in conductive material and one or more tuning elements physically coupled to the multi-band slot antenna is described.

32 Claims, 12 Drawing Sheets

TUNING ELEMENTS FOR SPECIFIC ABSORPTION RATE REDUCTION

BACKGROUND OF THE INVENTION

A large and growing population of users enjoy entertainment through the consumption of digital media items, such as music, movies, images, electronic books, and so on. Users employ various electronic devices to consume such media items. Among these electronic devices are electronic book readers, cellular telephones, personal digital assistants (PDAs), portable media players, tablet computers, netbooks, and the like. These electronic devices wirelessly communicate with a communications infrastructure to enable the consumption of the digital media items. Typically, the communications infrastructure dictates transmit power levels for the electronic devices to use when transmitting data to the communications infrastructure.

Some bodies of research suggest that radiation output by electronic devices during wireless transmission of data can cause damage to the human body when such radiation is absorbed. However, since electronic devices lack the ability to control their transmit power levels, such electronic devices cannot adjust their transmit power levels to reduce user exposure to radiation. This may also consequently cause these electronic devices to fail to comply with FCC regulations regarding the specific absorption rate (SAR) permitted to electronic devices. SAR is a measure of the rate at which energy is absorbed by the body when exposed to a radio frequency (RF) electromagnetic field. In addition, the user's body can block the RF electromagnetic field in the direction of the user's body, thus reducing the gain in that direction. This may also cause difficulty in meeting the SAR requirements.

Some electronic devices are capable of connecting with multiple wireless communication infrastructures concurrently. Each such connection to a wireless communication infrastructure causes radiation to be emitted, thus causing such devices to expose users to even greater amounts of radiation.

BRIEF DESCRIPTION OF THE DRAWINGS

The embodiments described herein will be understood more fully from the detailed description given below and from the accompanying drawings, which, however, should not be taken to limit the application to the specific embodiments, but are for explanation and understanding only.

DETAILED DESCRIPTION

Figure 1A:
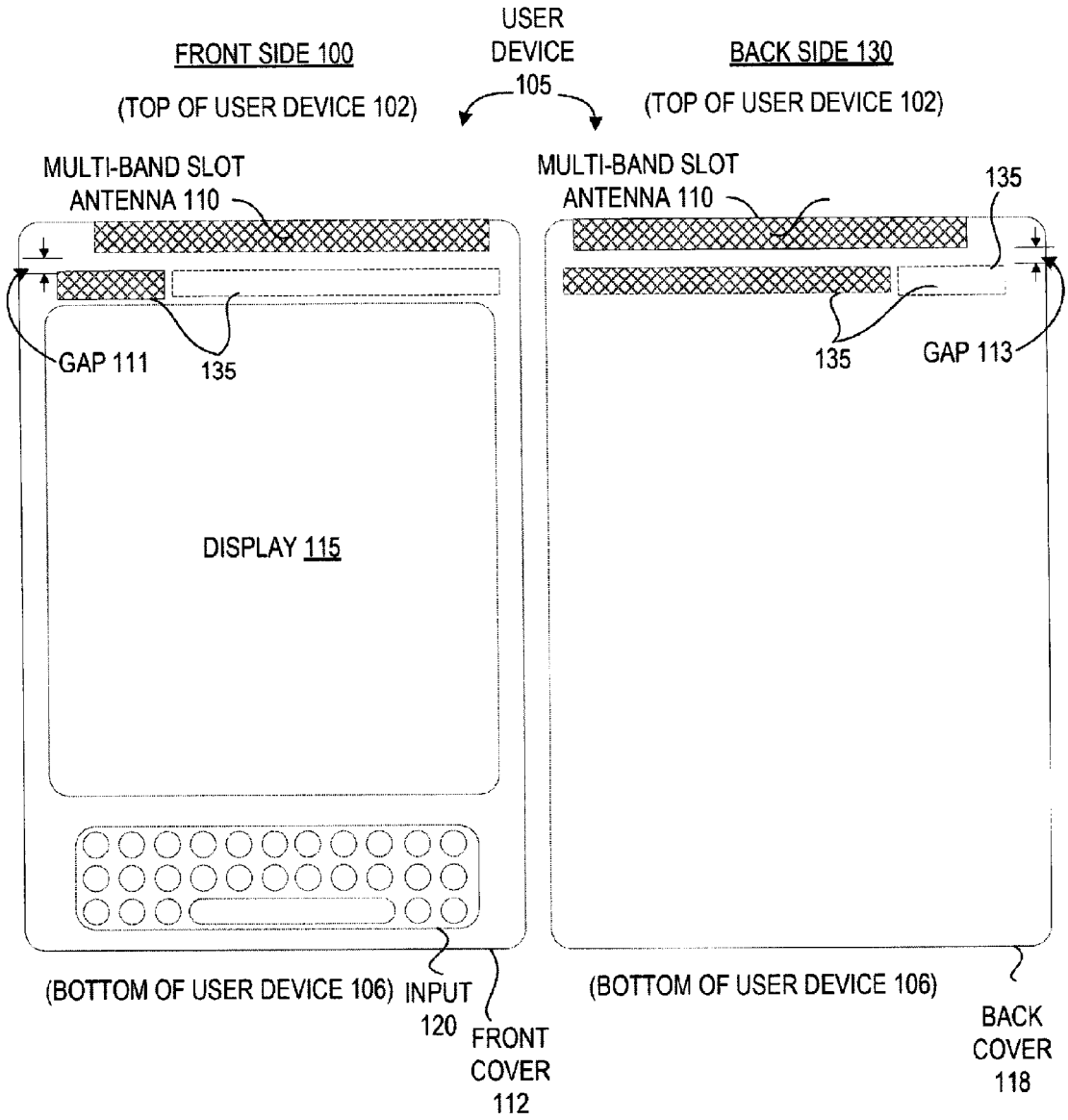
FIG. 1A illustrates a front side and a back side of a user device having a multi-band slot antenna and one or more tuning elements according to one embodiment.

Methods and systems for reducing the SAR of a user device, which are used to wirelessly communicate data, are described. The user device may be any content rendering device that includes a wireless modem for connecting the user device to a network. Examples of such user devices include electronic book readers, cellular telephones, personal digital assistants (PDAs), portable media players, tablet computers, netbooks, and the like. Embodiments of the present invention overcome the above shortcomings by directing a majority of the electromagnetic energy radiated from the user device's antenna away from the user using one or more tuning elements.

In one embodiment, a user device includes a multi-band slot antenna having multiple slot openings in conductive material, and one or more tuning elements physically coupled to the multi-band slot antenna. The one or more tuning elements, which may be a director or a reflector, change a direction of the multi-band slot antenna's surface current flow at a desired frequency in one of the frequency bands of the multi-band slot antenna. In one embodiment, by changing the antenna's surface current, the one or more tuning elements can direct a majority of the electromagnetic energy away from a human body part. For example, in one embodiment where the tuning element is a director that is disposed within a front side of the user device, the director attracts the majority of electromagnetic energy radiated from the multi-band slot antenna towards the front side of the user device. The director increases the electromagnetic energy radiated by the multi-band slot antenna towards the front side of the user device, and decreases the electromagnetic energy radiated by the multi-band slot antenna towards the back side of the user device. In another embodiment where the tuning element is a reflector that is disposed within a back side of the user device, the reflector reflects the majority of the electromagnetic energy radiated from the multi-band slot antenna away from the back side of the user device, increasing the electromagnetic energy radiated by the multi-band slot antenna towards the front side of the user device, and decreasing the electromagnetic energy radiated by the multi-band slot antenna towards the back side of the user device.

In other embodiments, the director can disposed within the back side of the user device, and the reflector can be disposed within the front side of the device reversing the direction of the majority of electromagnetic energy radiated from the multi-band slot antenna to be towards the back side of the user device. In another embodiment, both a director and a reflector can be used in connection with the same multi-band slot antenna to direct the majority of electromagnetic energy away from one of the sides (e.g., front or back sides) of the user device. By using the one or more tuning elements, the SAR of the multi-band slot antenna is reduced at the desired frequency while the performance remains that same at the other frequencies of the multi-band slot antenna. For example, a director can reduce the SAR of the user device by as much as half, such as from 10 mm to 5 mm. These embodiments may reduce an amount of radiation that is absorbed by the human body.

Figure 1B:
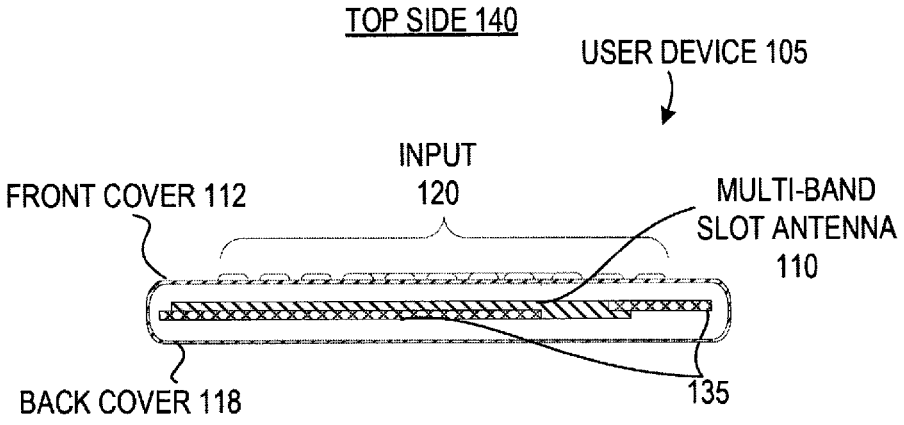
FIG. 1B illustrates a top of the user device of FIG. 1A according to one embodiment.

FIG. 1A illustrates a front side 100 and a back side 130 of a user device 105 having a multi-band slot antenna 110 and one or more tuning elements 135 according to one embodiment. FIG. 1B illustrates a top side 140 of the user device 105 of FIG. 1A. The user device 105 is capable of communicating with another device, such as an item providing system, via a network (e.g., public network such as the Internet or private network such as a local area network (LAN). The user device 105 is variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user device 105 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the depicted embodiment, the user device 105 includes a display 115 and optionally an input 120 housed in a front cover 112 on the front side 100. The display 115 may use any available display technology, such as electronic ink (e-ink), liquid crystal display (LCD), transflective LCD, light emitting diodes (LED), laser phosphor displays (LSP), and so forth. The input 120 may include a keyboard, touch pad, or other input mechanism. In one embodiment, the display 115 and input 120 are combined into one or more touch screens. Disposed within the user device 105 are a multi-band slot antenna 110, having multiple slot openings (not illustrated in FIGS. 1A and 1B) in conductive material, and one or more tuning elements 135. As shown, the multi-band slot antenna 110 is positioned near a top 102 of the user device 105. However, the antenna may also be positioned at other locations, such as at a side (e.g., left or right side) of the user device 105 or near the bottom 106 of the user device 105.

The multi-band slot antenna 110 includes conductive material surface with multiple slot openings (also referred to as holes, apertures, or slot cut outs). In one embodiment, the conductive material is a metal plate in which the slot openings are formed by removing portions of the metal plate. In another embodiment, the conductive material is a printed circuit board trace. Alternatively, the conductive material may be flexible material disposed on or within the user device 105 to form the multi-band slot antenna having multiple slot openings and/or the tuning elements 135. The conductive material may be fabricated as one integrated piece or as separate pieces. When the conductive material surface is driven as an antenna by a driving frequency, the slot openings radiate electromagnetic energy. The shape and size of the slot openings, as well as the driving frequency, determine the radiation pattern. The radiation patterns of slot antennas are typically omnidirectional when no tuning elements are used. The slot opening's size, shape, and cavity offer design variables that can be used to tune performance of the multi-band slot antenna 110. Unlike a single slot antenna, which includes a single slot opening that radiates electromagnetic energy in a single frequency band, the multi-band slot antenna 110 includes multiple slot openings that radiate electromagnetic energy in multiple frequency bands. For example, the multi-band slot antenna 110 may be configured to operate in multiple frequency bands, such as PCS 1900 (1850-1990 MHz), UMTS (1920-2170 MHz), WLAN 802.11a/b/g (2400-2483 MHz and 5250-5350 MHz), Bluetooth frequency bands, or the like. The multi-band slot antenna 110 can be used to support WiFi, GSM, CDMA, WCDMA, TDMA, UMTS, LTE, or other types of wireless communication protocols of digital network wireless technologies.

Disposed near and physically coupled to the multi-band slot antenna 110 of the user device 105 are one or more tuning elements 135. There are times when the user device 105 comes into contact or within close proximity to portions of a human body, such as, for example, a user's hand, leg, or head. During transmission or reception of data, multi-band slot antenna 110 emits a radio frequency (RF) field that may be absorbed by the portions of the human body. The amount of power/radiation that may be absorbed from the RF field by the portions of the human body is based on a distance of the human body part from the multi-band slot antenna 110. The power of the RF field drops off at a rate of $1/d^2$, where d is distance from the multi-band slot antenna 110. Accordingly, the closer a human body part is to the multi-band slot antenna 110, the more radiation that may be absorbed by the human body. As described above, electronic devices that transmit RF electromagnetic fields need to comply with SAR requirements that specify the rate at which energy is absorbed by the body when exposed to the RF electromagnetic field. The embodiments described herein regarding the one or more tuning elements 135 may achieve a reduction in SAR of the user device 105. More specifically, the tuning elements 135 are conductive elements that are configured to change a direction of the multi-band slot antenna's surface current at a desired frequency during operation of the multi-band slot antenna 110. By changing the surface current, the tuning elements 135 direct a majority of the electromagnetic energy away from one of the sides of the user device, such as the front side as depicted and described with respect to FIGS. 1A and 1B. In these embodiments, the tuning elements 135 direct the electromagnetic energy radiated by the multi-band slot antenna 110 towards the front side 100 of the user device 105, and decrease the electromagnetic energy radiated by the multi-band slot antenna 110 towards the back side 130 of the user device 105. The radiation pattern of the multi-band slot antenna 110 and the tuning elements 135 is directional towards the one side of the user device 105, instead of being roughly omnidirectional when no tuning elements are used with slot antennas. The radiation patterns of the multi-band slot antenna 100 and the one or more tuning elements are described and illustrated with respect to FIGS. 4A-4F.

In one embodiment, the one or more tuning elements 135 and the multi-band slot antenna 110 are fabricated as two separate components and then physically coupled together.

Alternatively, the one or more tuning elements 135 and the multi-band slot antenna 110 are physically coupled by being fabricated as an integrated part. In yet another embodiment, the one or more tuning elements 135 are not physically coupled to the multi-band slot antenna 110.

In one embodiment, the one or more tuning elements 135 include a director that is configured to attract the majority of the electromagnetic energy radiated by the multi-band slot antenna 110 towards the front side 100 of the user device 105. In another embodiment, the one or more tuning elements 135 include a reflector that is configured to reflect the majority of the electromagnetic energy radiated by the multi-band slot antenna 110 away from the back side 130 of the user device 105. In another embodiment, the user device 105 includes both a director and a reflector. In another embodiment, the user device 105 includes multiple directors.

As depicted in FIGS. 1A and 1B, the tuning elements 135 include a director disposed within the front side 100 within the front cover 112 of the user device 105 and a reflector disposed within the back side 130 within the back cover 118 of the user device 105. The director is disposed with a gap 111 between the director and the multi-band slot antenna 110 and the reflector is disposed with a gap 113 between the reflector and the multi-band slot antenna 110. In one embodiment, the gaps 111 and 113 are air gaps. In another embodiment, the gaps 111 and 113 are material gaps. In one embodiment, the gaps 111 and 113 are the same dimension. In another embodiment, the gaps 111 and 113 may be different dimensions. It should be noted that some of the tuning elements 135 are shown in the depicted embodiment using dashed lines to indicate that these tuning elements are located on the opposite side of the user device 105. It should also be noted that the multi-band slot antenna 110 and the tuning elements 135 are not disposed on a surface of the user device 110, but rather are disposed inside the front and back covers 112 and 118. However, in alternative embodiments these components may be disposed on a surface of the user device 105.

As shown in FIG. 1A, the multi-band slot antenna 110 is disposed at the top 102 of the user device 105 such that the multi-band slot antenna 110 wraps from the front side 100 to the back side 130, and the tuning elements 135 are disposed between the multi-band slot antenna 110 and the bottom 106 of the user device 105. However, the one or more tuning elements 135 may also be disposed at other locations with relation to the multi-band slot antenna 110, such as between the multi-band slot antenna 110 and the top 102 of the user device 105, for example when the multi-band slot antenna 110 is disposed near or at the bottom 106 of the user device 105.

Figure 2:
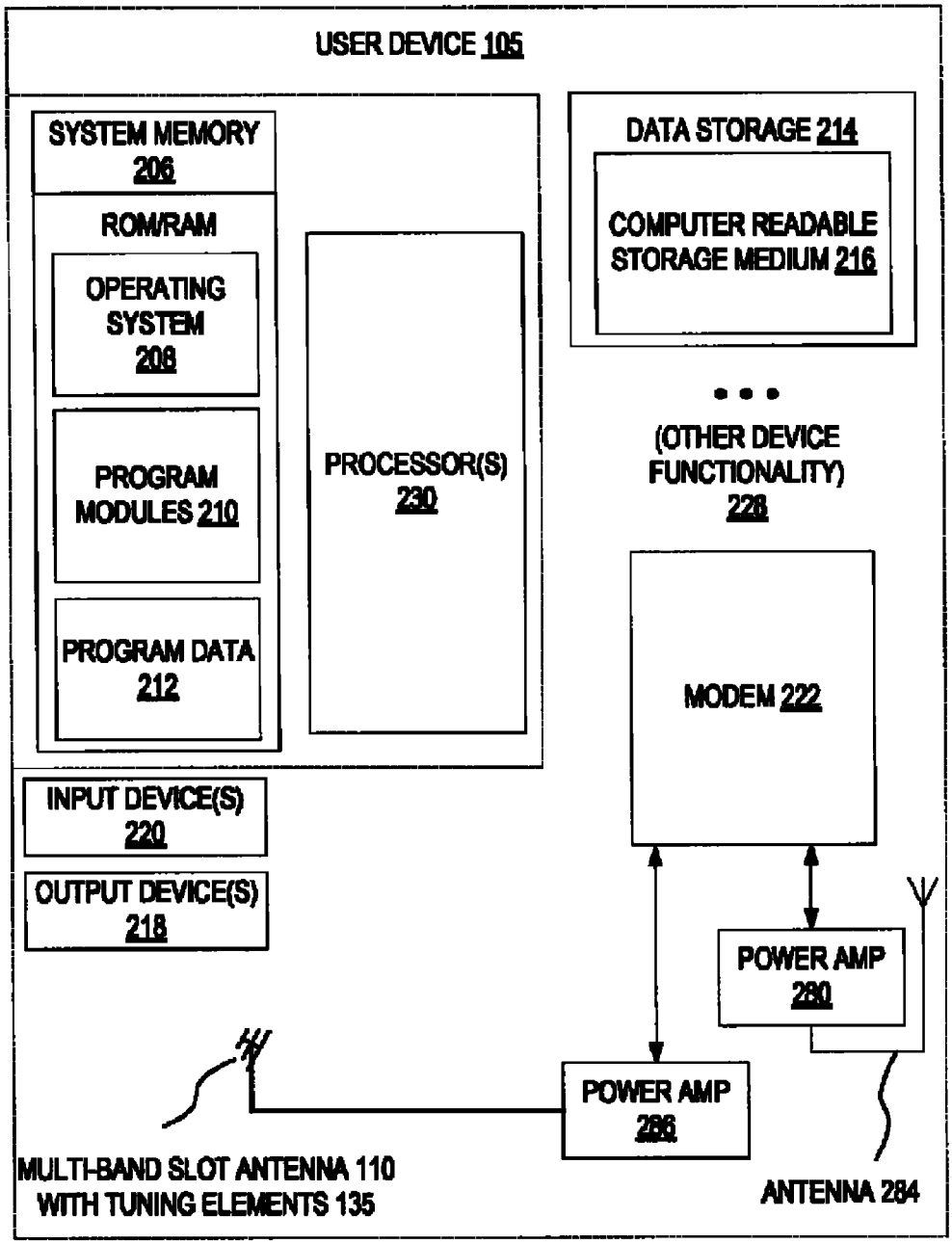
FIG. 2 is a block diagram of a user device having a multi-band slot antenna and one or more tuning elements according to one embodiment.

FIG. 2 is a block diagram of a user device 105 having the multi-band slot antenna 110 and the one or more tuning elements 135 according to one embodiment. The user device 105 includes one or more processors 230, such as one or more CPUs, microcontrollers, field programmable gate arrays, or other types of processing devices. The user device 105 also includes system memory 206, which may correspond to any combination of volatile and/or non-volatile storage mechanisms. The system memory 206 stores information which provides an operating system component 208, various program modules 210, program data 212, and/or other components. The user device 105 performs functions by using the processor(s) 230 to execute instructions provided by the system memory 206.

The user device 105 also includes a data storage device 214 that may be composed of one or more types of removable storage and/or one or more types of non-removable storage. The data storage device 214 includes a computer-readable storage medium 216 on which is stored one or more sets of instructions embodying any one or more of the functions of the user device 105, as described herein. As shown, instructions may reside, completely or at least partially, within the computer readable storage medium 216, system memory 206 and/or within the processor(s) 230 during execution thereof by the user device 105, the system memory 206 and the processor(s) 230 also constituting computer-readable media. The user device 105 may also include one or more input devices 220 (keyboard, mouse device, specialized selection keys, etc.) and one or more output devices 218 (displays, printers, audio output mechanisms, etc.).

The user device 105 further includes a wireless modem 222 to allow the user device 105 to communicate via a wireless network (e.g., such as provided by a wireless communication system) with other computing devices, such as remote computers, an item providing system, and so forth. The wireless modem 222 allows the user device 105 to handle both voice and non-voice communications (such as communications for text messages, multimedia messages, media downloads, web browsing, etc.) with a wireless communication system. The wireless modem 222 may provide network connectivity using any type of digital mobile network technology including, for example, cellular digital packet data (CDPD), general packet radio service (GPRS), enhanced data rates for GSM evolution (EDGE), universal mobile telecommunications system (UMTS), 1 times radio transmission technology (1xRTT), evaluation data optimized (EVDO), high-speed downlink packet access (HSDPA), WiFi, etc. In addition to wirelessly connecting to a wireless communication system, the user device 105 may also wirelessly connect with other user devices. For example, user device 105 may form a wireless ad hoc (peer-to-peer) network with another user device.

The wireless modem 222 may generate signals and send these signals to power amplifier (amp) 280 or power amp 286 for amplification, after which they are wirelessly transmitted via the multi-band slot antenna 110 or antenna 284, respectively. The antenna 284, which is an optional antenna that is separate from the multi-band slot antenna 110, may be any directional, omnidirectional, or non-directional antenna in a different frequency band than the frequency bands of the multi-band slot antenna 110. The antenna 284 may also transmit information using different wireless communication protocols than the multi-band slot antenna 110. In addition to sending data, the multi-band slot antenna 110 and the antenna 284 also receive data, which is sent to wireless modem 222 and transferred to processor(s) 230. It should be noted that, in other embodiments, the user device 105 may include more or less components as illustrated in the block diagram of FIG. 2.

In one embodiment, the user device 105 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first slot opening of the multi-band slot antenna that operates at a first frequency band and the second wireless connection is associated with a second slot opening of the multi-band slot antenna that operates at a second frequency band. In another embodiment, the first wireless connection is associated with the multi-band slot antenna 110 and the second wireless connection is associated with the antenna 284. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 222 is shown to control transmission to both antennas 110 and 284, the user device 105 may alternatively include multiple wireless modems, each of which is configured to transmit/receive data via a different antenna and/or wireless transmission protocol. In addition, the user device 105, while illustrated with two antennas 110 and 284, may include more or fewer antennas in various embodiments.

The user device 105 delivers and/or receives items, upgrades, and/or other information via the network. For example, the user device 105 may download or receive items from an item providing system. The item providing system receives various requests, instructions, and other data from the user device 105 via the network. The item providing system may include one or more machines (e.g., one or more server computer systems, routers, gateways, etc.) that have processing and storage capabilities to provide the above functionality. Communication between the item providing system and the user device 105 may be enabled via any communication infrastructure. One example of such an infrastructure includes a combination of a wide area network (WAN) and wireless infrastructure, which allows a user to use the user device 105 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 105.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

Figure 3:
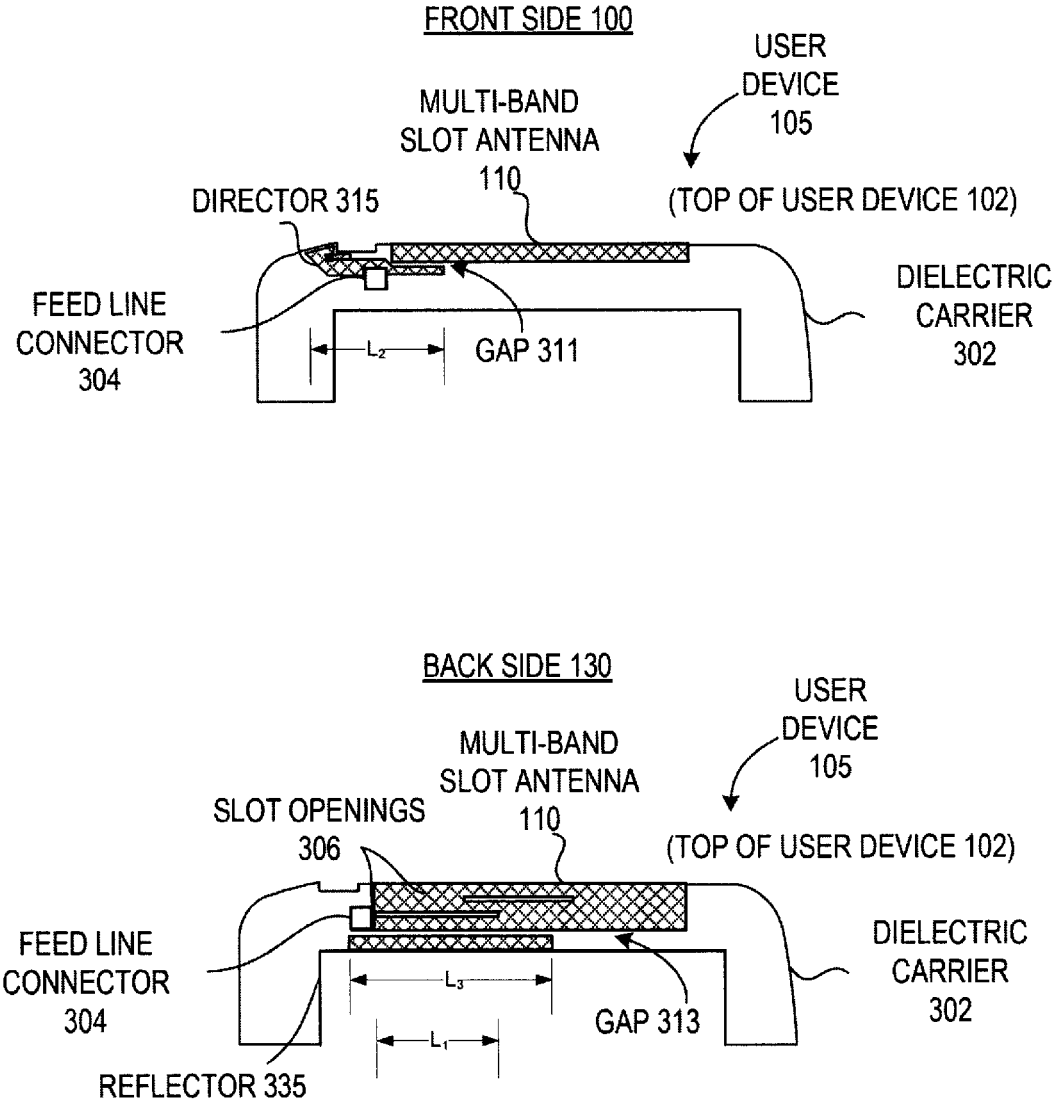
FIG. 3 illustrates a front side and a back side of a dielectric carrier of the user device upon which a director and a reflector are disposed near the multi-band slot antenna according to one embodiment.

FIG. 3 illustrates a front side 100 and a back side 130 of a dielectric carrier 302 of the user device 105 upon which a director 315 and a reflector 335 are disposed near the multi-band slot antenna 110 according to one embodiment. The dielectric carrier 302 may be any non-conductive material of the user device 105 upon which the conductive material of the multi-band slot antenna 110, director 315, and reflector 335 can be disposed without making electrical contact with other metal of the user device 105. In this embodiment, a first portion of the conductive material is disposed on the front side 100 of the dielectric carrier 302 and a second portion of the conductive material is disposed on the back side 130 of the dielectric carrier 302, such as a support member or a substrate as described below. In this embodiment, the slot openings 306 of the multi-band slot antenna 110 are disposed on the back side 130. The director 315, reflector 335, and/or multi-band slot antenna 110 may be fabricated as one integrated piece. Alternatively, the director 315, reflector 335, and/or multi-band slot antenna 110 may be fabricated as separate components and disposed on the dielectric carrier 302.

In one embodiment, the dielectric carrier 302 is a support member disposed within the front and back covers 112 and 118. The dielectric carrier 302 may be used to support other components of the user device 105, such as the display 115. Alternatively, the dielectric carrier 302 may be part of the front or back covers 112 and 118. In another embodiment, the dielectric carrier 302 is a printed circuit board or a portion of the printed circuit board.

In the depicted embodiment, the director 315 is disposed at the top 102 and on the front side 100 with a gap 311 between the multi-band slot antenna 110 and the director 315, and the reflector 335 is disposed at the top 102 and on the back side 130 with a gap 313 between the multi-band slot antenna 110 and the reflector 335. In one embodiment, the gaps 311 and 313 are approximately 1 millimeter (mm). In another embodiment, the gaps 311 and 313 are in a range between approximately 0.5 mm and 1.5 mm. In one embodiment, the gaps 311 and 313 are the same dimension. In other embodiments, the gaps 311 and 313 are dissimilar dimensions. The gaps 311 and 313 may be air gaps, or alternatively, material gaps.

In the depicted embodiment, the user device 105 includes a feed line connector 304 that is coupled to the multi-band slot antenna 110, director 315, and reflector 335. The feed line connector 304 couples the multi-band slot antenna 110 to a feed line (also referred to as the transmission line), which is a physical connection that carriers the RF signal to and/or from the multi-band slot antenna 110. The feed line connector 304 may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector 304 is physically coupled to the multi-band slot antenna 110 at the back side 130 of the dielectric carrier 302 and is physically coupled to the director 315 at the front side 100 of the dielectric carrier 302. In this embodiment, the reflector 335 is not physically coupled to the multi-band slot antenna 110 and the feed line connector 304. However, in another embodiment, the reflector 335 may be physically coupled to the multi-band slot antenna 110.

In one embodiment, the feed line connector 304 is disposed at one end of the multi-band slot antenna 110 and a first slot opening 306 is disposed closer to the feed line connector 304 than the other slot openings 306. The first slot opening 306 is configured to operate in a first frequency band. In this embodiment, the director 315 is disposed closer to the first slot opening 306 than the other slot openings 306. The director 315 is configured to direct the majority of the electromagnetic energy radiated by the multi-band slot antenna 110 in the first frequency band away from the back side 130 of the user device 105. Alternatively, the director 315 may be configured to direct the electromagnetic energy radiated by the multi-band slot antenna in other frequency bands. In one embodiment, the first slot opening has a length $L_1$ of approximately half wavelength, lambda ($\lambda$)/2, where lambda ($\lambda$) is the length of one electromagnetic wave of the first frequency band at which the first slot antenna operates, and the director 315 has a length $L_2$ in a range between approximately λ/8 and λ/4. For example, for the PCS band, lambda (λ)=15.8 cm. Alternatively, other lengths may be used for the slot openings and the directors based on the design requirements of the multi-band slot antenna 110. In another embodiment, the reflector 335 has a length $L_3$ in a range between lambda (λ)/4 and 3 lambda (λ)/4.

In one embodiment, the director 315 has a rectangle shape. In another embodiment, the director 315 can have an arbitrary shape, such as a shape that fits within the geometric constraints of the dielectric carrier 302, such as illustrated in FIG. 3. It should be noted that although the director 315 extends beyond one end of the first portion of the multi-band slot antenna 110 that is disposed on the same plane on the front side 100, in other embodiments, the director 315 may be disposed in other positions relative to the multi-band slot antenna 110. For example, the director 315 may have a rectangular shape that is disposed substantially parallel to the multi-band slot antenna 110 in the same plane on the front side 100. The substantially parallel director may or may not extend beyond the ends of the multi-band slot antenna 110. In another embodiment, the multi-band slot antenna 110 is disposed on only on the top side 140 and back side 130 of the dielectric carrier 302, and the director 315 is disposed on the front side 100 of the dielectric carrier 302.

It should be noted that the depicted multi-band slot antenna 110 does not represent the actual shape of the antenna 110, since the shape may be designed based on the number of frequency bands and which frequency bands are to be supported. FIG. 3 illustrates only two slot openings 306, which each support a different frequency band. In other embodiments, more slot openings 306 can be used to support more than two frequency bands. In addition, the slot openings 306 have been depicted at arbitrary locations and having arbitrary sizes, since the locations and sizes of the slot openings 306 will vary based on the design of the multi-band slot antenna 110. It should also be noted that both the director 315 and the reflector 335 have been depicted in FIG. 3, in other embodiments, other configurations are possible, such as the dielectric carrier 302 having just the director 315 or just the reflector 335, multiple directors 315 with or without the reflector 335, or the like.

Figure 4B:
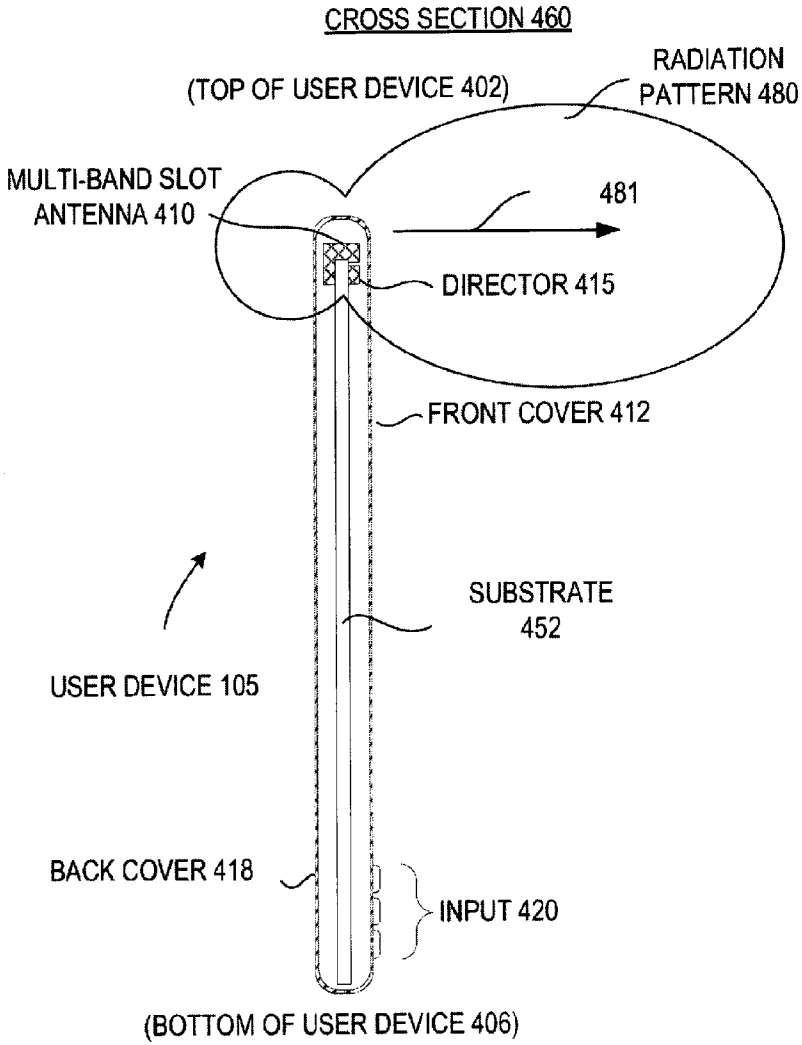
FIG. 4B illustrates a cross-sectional side view of a radiation pattern from a user device having a multi-band slot antenna and a director according to one embodiment.
Figure 4A:
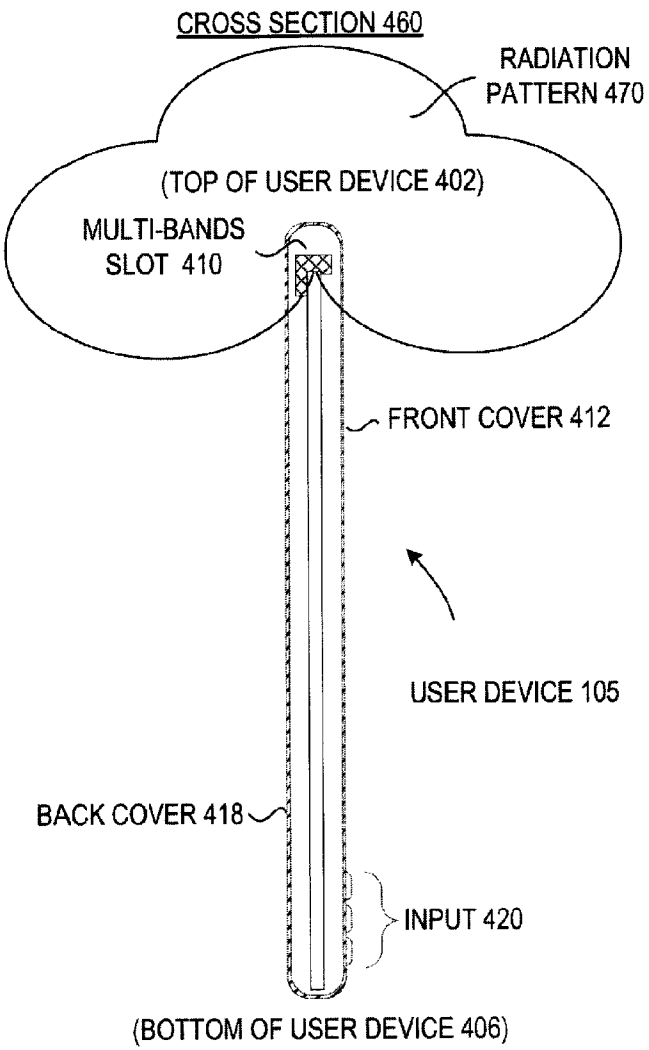
FIG. 4A illustrates a cross-sectional side view of a radiation pattern from the user device without tuning elements.
Figure 4D:
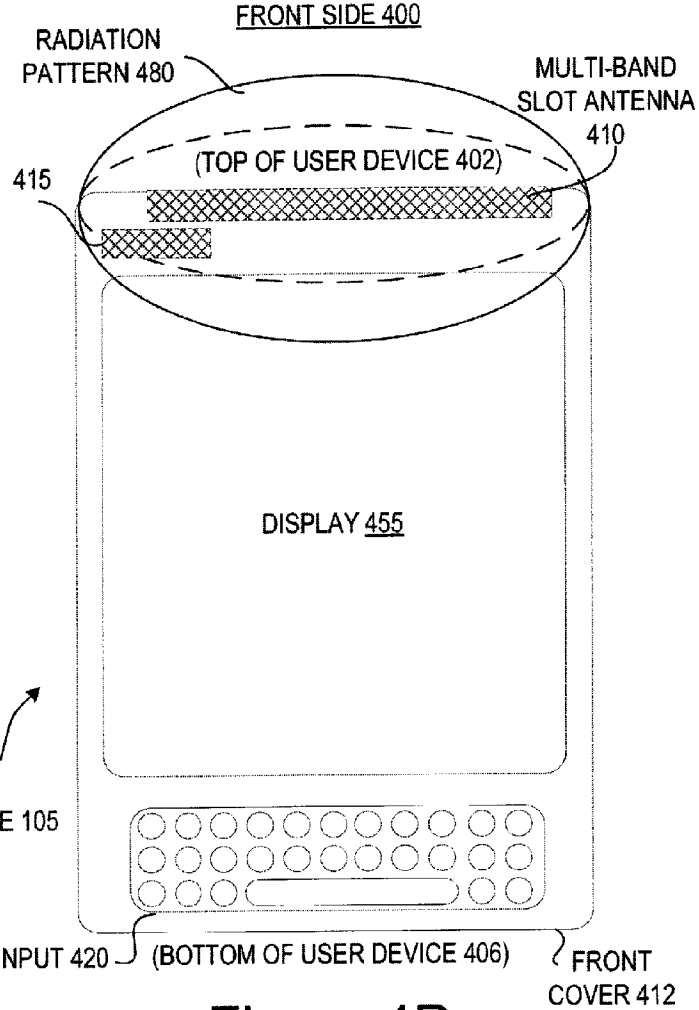
FIG. 4D illustrates a front side view of the radiation pattern from the user device having the multi-band slot antenna and the director according to one embodiment.
Figure 4C:
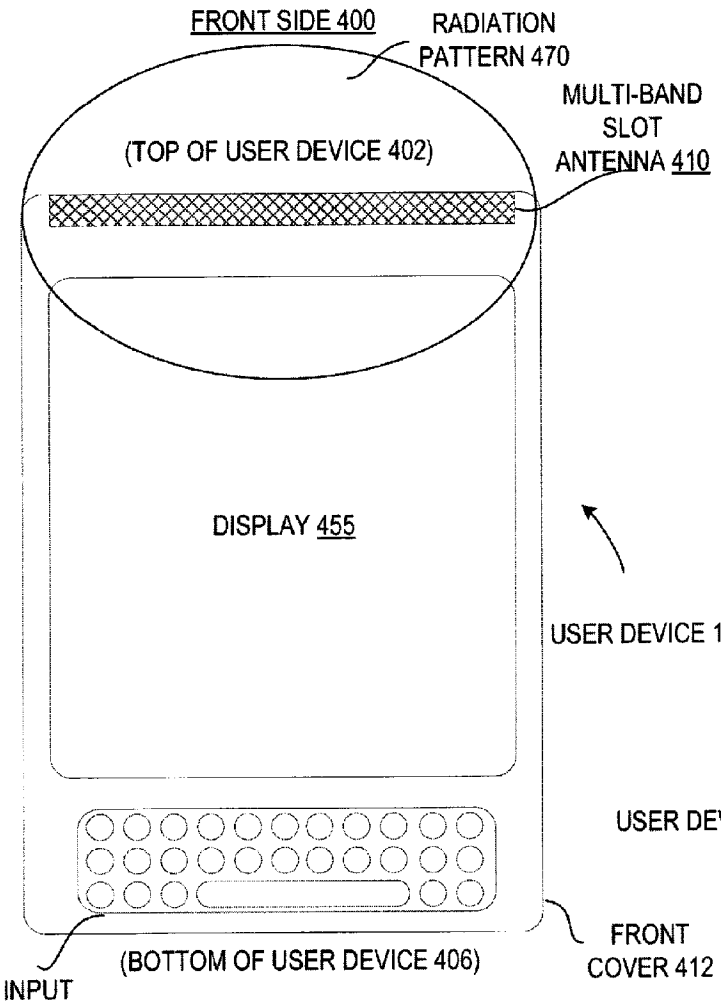
FIG. 4C illustrates a front side view of the radiation pattern from the user device without tuning elements.
Figure 4F:
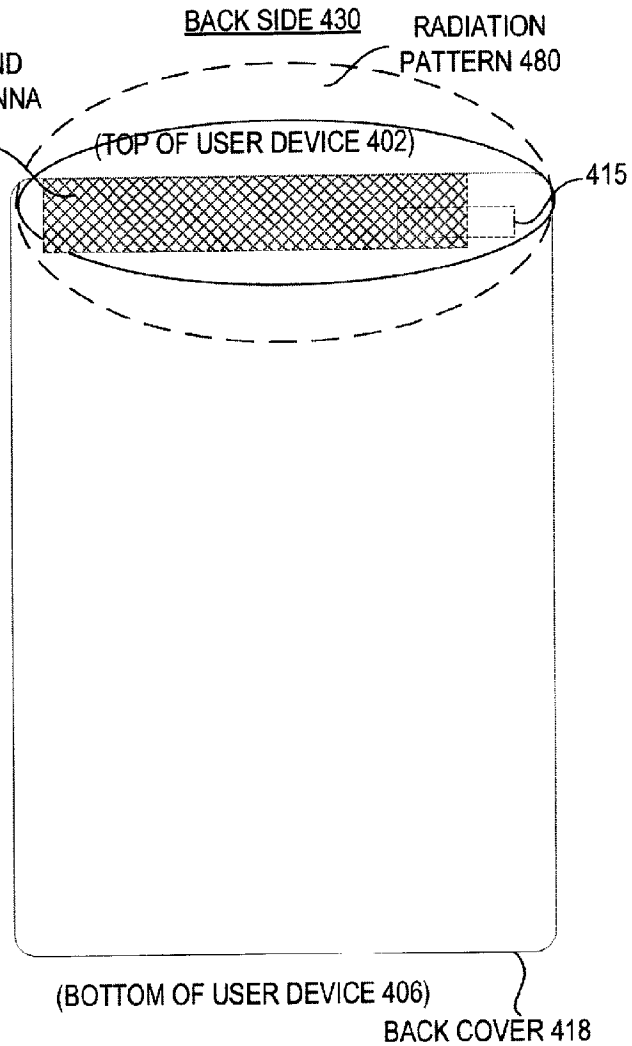
FIG. 4F illustrates a back side view of the radiation pattern from the user device having the multi-band slot antenna and the director according to one embodiment.
Figure 4E:
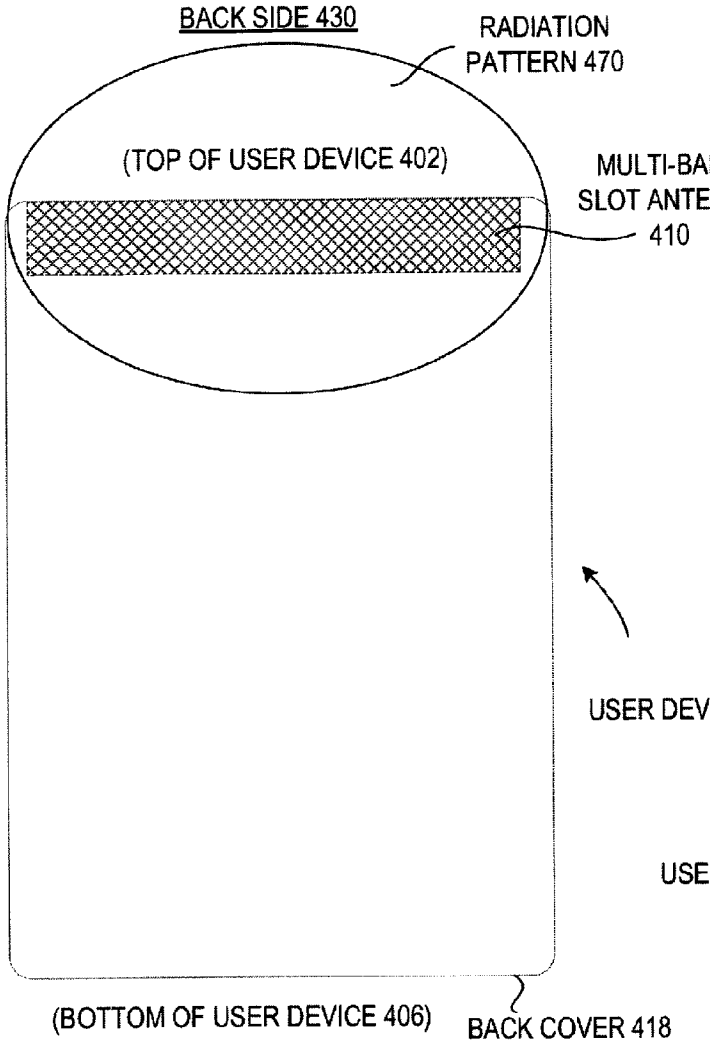
FIG. 4E illustrates a back side view of the radiation pattern from the user device without tuning elements.

FIGS. 4A-4F illustrates cross-sectional side views, front side views, and back side views of a radiation pattern 480 from a user device 105 having the multi-band slot antenna 410 and the director 415 (FIGS. 4B, 4D, and 4F), and a radiation pattern 470 from a user device 105 without tuning elements 135 (FIGS. 4A, 4C, and 4E). The user device 105 of FIGS. 4A-4F includes a multi-band slot antenna 410 disposed near a top 402 of the user device 105, front and back covers 412 and 418, a display 455, a substrate 402, and inputs 420 disposed near a bottom 406 of the user device 105. However, the user device 105 of FIGS. 4A, 4C, and 4E does not have the one or more tuning elements 135, whereas the user device 105 of FIGS. 4B, 4D, and 4F has a director 415.

Referring to FIGS. 4A and 4B, both cross-sectional side views 460 show the multi-band slot antenna 410, but the cross-sectional side view 460 of FIG. 4B shows the director 415 housed within the front cover 412 and back cover 418 of the user device 105. The cross-sectional side views 460 show the multi-band slot antenna 410 being disposed at a topside of a non-conductive substrate 452, which may be a rigid substrate (e.g., a printed circuit board (PCB)) or a flexible substrate (e.g., a polyimide film, polyester film, or polyether ether ketone (PEEK) film). For example, the multi-band slot antenna 410 can be disposed so that a first portion of the conductive material is disposed on a front side of the substrate 452, a second portion of the conductive material is disposed on a top side of the substrate 452, and a third portion of the conductive material is disposed on a back side 430 of the substrate 452. The director 415 is also disposed on the front side of the substrate 452 in the user device 105 of FIG. 4B. Alternatively, the multi-band slot antenna 410 and the director 415 can be disposed in other configurations, such as the multi-band slot antenna 410 being disposed on the back side 430 of the substrate 452 and the director 415 being disposed on the front side of the substrate 452, or the multi-band slot antenna 410 being disposed on the substrate 452 and the director 415 being disposed on an inside of the front or back covers 412, 418, or being disposed on another dielectric carrier within the user device 105. Since the director 415 needs to be disposed on dielectric material, in one embodiment, the director 415 may be disposed on the cover itself when the cover is non-metallic. Alternatively, when the cover is metal, dielectric material can be secured to the metallic cover to isolate the director 415 from the metallic cover. In another embodiment, the director 415 can be positioned within the front cover 412 such that the director is receded within the front cover 412. Alternatively, the multi-band slot antenna 410 and the director 415 can be disposed on other types of dielectric carriers, such as a support member such as illustrated in FIG. 3.

The multi-band slot antenna 410 radiates electromagnetic energy to form a radiation pattern. The radiation pattern 470, generated by the multi-band slot antenna 410 of the user device 105 without tuning elements 135 (FIG. 4A), is substantially near omnidirectional (e.g., the front to back ratio of radiation gain is about 0 dB), whereas the radiation pattern 480, generated by the multi-band slot antenna 410 of the user device 105 with the director 415 (FIG. 4B), is substantially directional (e.g., the front to back ratio of the radiation gain is approximately 3 to 10 dB). Alternatively, other radiation gains may be achieved, for example, when using a director and a reflector the front to back ratio of radiation gain approximately 7 dB can be achieved. As described herein, the tuning elements 135 change the surface current of the multi-band slot antenna to direct the electromagnetic energy. In particular, the director 415 changes the surface current of the multi-band slot antenna 410 to direct a majority of the electromagnetic energy to one side of the user device 105, as noted by the arrow 481 in FIG. 4B. In the depicted embodiment, the director 415 attracts the electromagnetic energy towards a front side 400 of the user device 105, as illustrated in the radiation pattern 480. The director 415 increases the electromagnetic energy radiated by the multi-band slot antenna 410 towards the front side 400 of the user device 105, i.e., electromagnetic energy radiated out from the front cover 412, and decreases the electromagnetic energy radiated by the multi-band slot antenna 410 towards the back side 430 of the user device 404, i.e., electromagnetic energy radiated out from back cover 418.

As shown in FIGS. 4A-4F, the amount of electromagnetic energy radiated from the multi-band slot antenna 410 is greater at the front cover 412 than at the back cover 418. The hashed lines of the radiation pattern 480 in FIGS. 4D and 4F indicate the magnitude of the electromagnetic energy at the opposite side of the user device for comparison to the radiation pattern 470 (in FIGS. 4C and 4E), which is substantially isotropic. For example, in FIG. 4D, the electromagnetic energy (solid line) at the front side 400 is greater than the electromagnetic energy (dashed line) at the opposite side, and, in FIG. 4F, the electromagnetic energy (solid line) at the back side 430 is less than the electromagnetic energy (dashed line) at the opposite side. It should be noted that although the depicted embodiments direct the majority of electromagnetic energy towards the front side 400 of the user device 105, other configurations are possible, such as to direct the electromagnetic energy towards the back side 430 of the user device 105, or the like. In addition, the multi-band slot antenna 410 and director 415 are disposed at the top 402 of the user device 105. In other embodiments, the multi-band slot antenna 410 and director 415 may be disposed at other locations, such as the bottom 506, or one a side (e.g., left or right side) of the user device 105 as would be appreciated by one of ordinary skill in the art having the benefit of this disclosure.

Figure 4G:
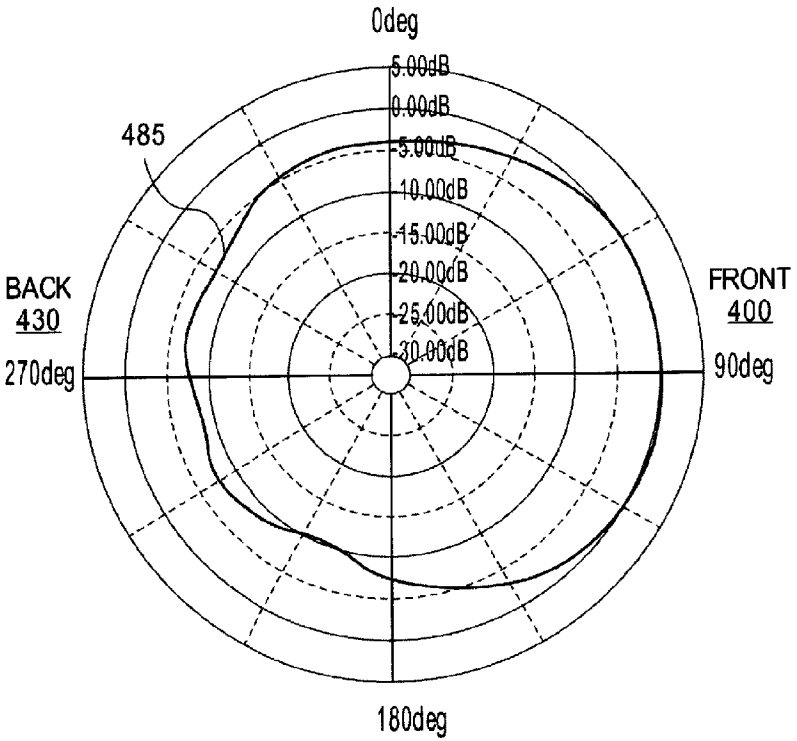
FIG. 4G is a graph of an exemplary radiation pattern from the user device without tuning elements.
Figure 4H:
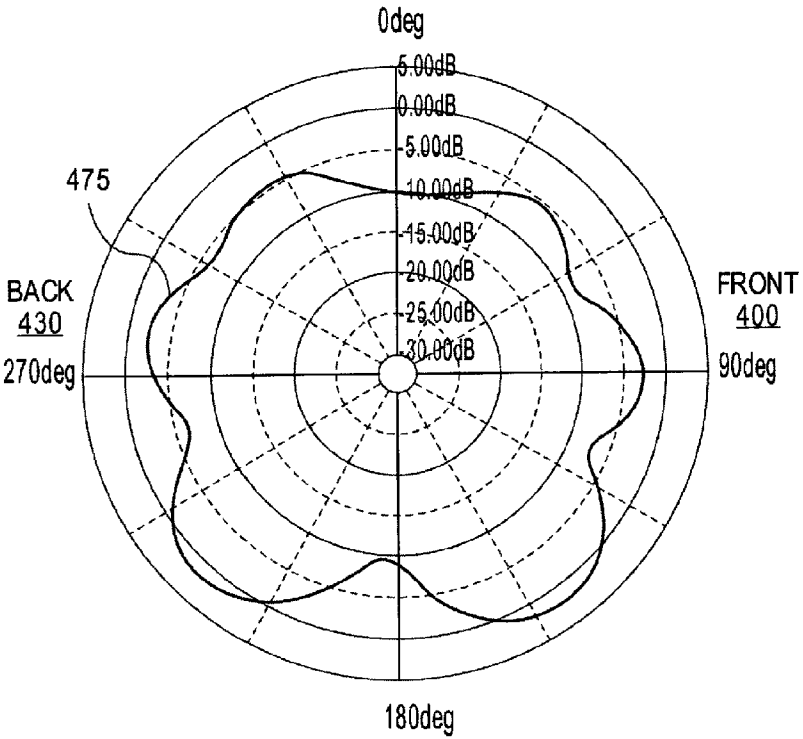
FIG. 4H is a graph an exemplary radiation pattern from a user device having a multi-band slot antenna with a tuning element according to one embodiment.

The director 415 can be used to direct the majority of electromagnetic energy away from a human body part, such as a leg, a hand, a head, for examples, reducing the SAR of the user device 105 to comply with SAR requirements. In one embodiment, the director 415 can reduce the SAR of the user device 105 by as much as half, such as from 2.57 W/Kg to 1.34 W/Kg. For example, the distance of the user device under test to a Phantom liquid is therefore reduced from approximately 10 mm to 5 mm. FIG. 4G is a graph of an exemplary radiation pattern 475 from the user device without tuning elements. FIG. 4H is a graph of an exemplary radiation pattern 485 from a user device having a multi-band slot antenna with a director 415 according to one embodiment. Alternatively, the director 415 may reduce the SAR of the user device 105 by other amounts as would be appreciated by one of ordinary skill in the art having the benefit of this disclosure.

Figure 5:
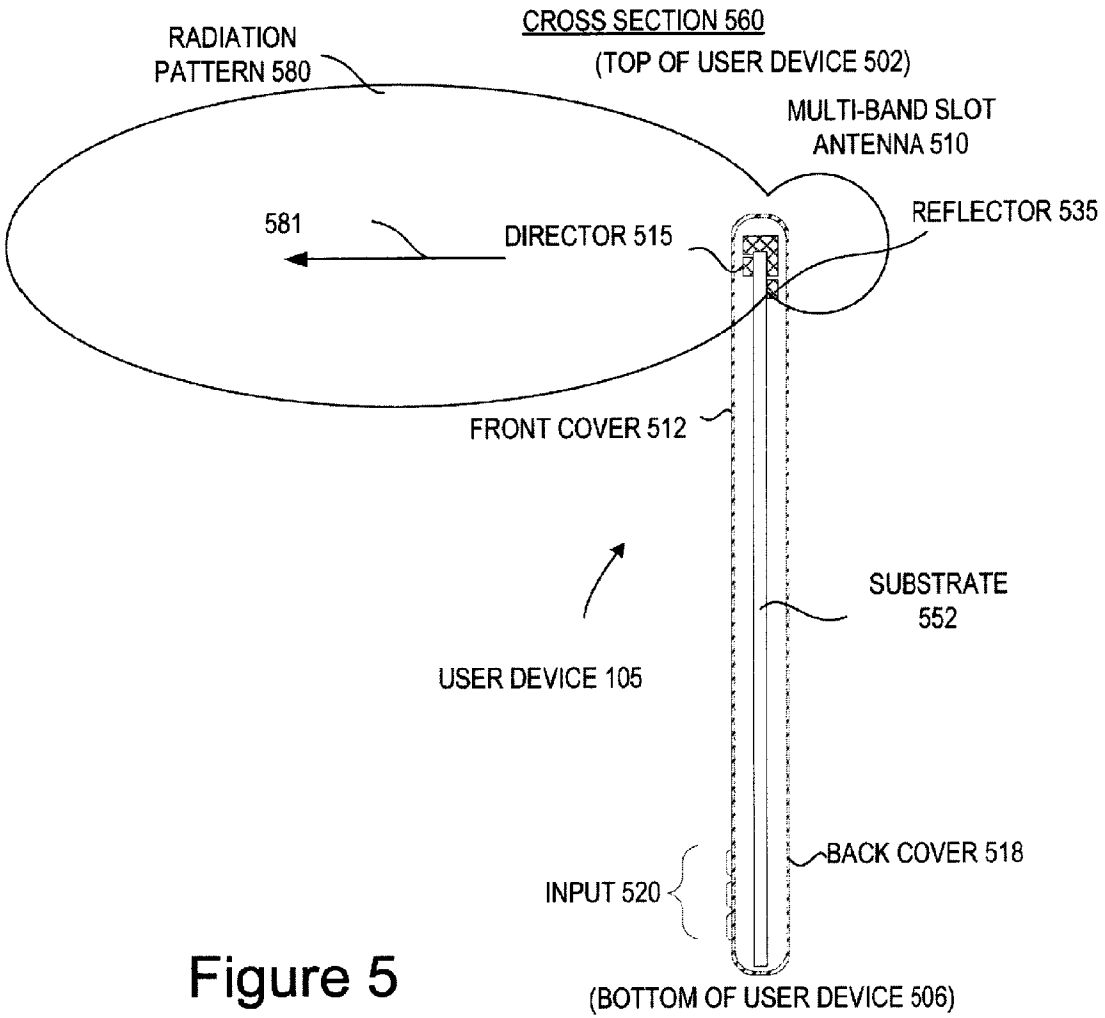
FIG. 5 illustrates cross-sectional side views of a radiation pattern from the user device having a multi-band slot antenna, a director, and a reflector according to one embodiment.

FIG. 5 illustrates cross-sectional side views of a radiation pattern 580 from the user device 105 having a multi-band slot antenna 510, a director 515, and a reflector 535 according to one embodiment. The user device 105 includes the multi-band slot antenna 510 disposed at a top 502 of the user device 105, front and back covers 512 and 518, a substrate 502, and inputs 520 disposed at a bottom 506 of the user device 105. The user device 105, unlike the user device 105 of FIGS. 4A-4F, includes both the director 515 and the reflector 535. The multi-band slot antenna 510 radiates electromagnetic energy to form the radiation pattern 580. The radiation pattern 580, like the radiation pattern 480, is substantially directional. The director 515 and reflector 535 change the surface current of the multi-band slot antenna 510 to direct a majority of the electromagnetic energy to one side of the user device 105, as noted by the arrow 581. In the depicted embodiment, the director 515 attracts the electromagnetic energy towards the front side of the user device 105, and the reflector 535 reflects the electromagnetic energy away from the back side of the user device 105, as illustrated in the radiation pattern 580. The director 515 and reflector 535 collectively increase the electromagnetic energy radiated by the multi-band slot antenna 510 towards the front side of the user device 105, i.e., electromagnetic energy radiated out from the front cover 512, and collectively decrease the electromagnetic energy radiated by the multi-band slot antenna 510 towards the back side of the user device 504, i.e., electromagnetic energy radiated out from back cover 518.

The radiation pattern 580 is shown as being more directed in the direction of the arrow 581 than the radiation patterns 470 and 480, since both the director 515 and reflector 535 are used to direct the majority of electromagnetic energy out of the front side of the user device 105. Like described above with respect to the user device 105 of FIGS. 4B, 4D, and 4F, the director 515 and reflector 535 may direct the majority of electromagnetic energy in other directions, such as out the back side of the user device 105, or the like. Similarly, the multi-band slot antenna 510, director 515, and reflector 535 can be disposed at other location than the top 502 of the user device 105 as would be appreciated by one of ordinary skill in the art having the benefit of this disclosure.

In one embodiment, the director 515 and reflector 535 can reduce the SAR of the user device 105 by more than the director 415 can. For example, the director 515 and reflector 535 can reduce the SAR of the user device 105 by more than half. Alternatively, the director 515 and reflector 535 may reduce the SAR of the user device 105 by other amounts as would be appreciated by one of ordinary skill in the art having the benefit of this disclosure.

Figure 6A:
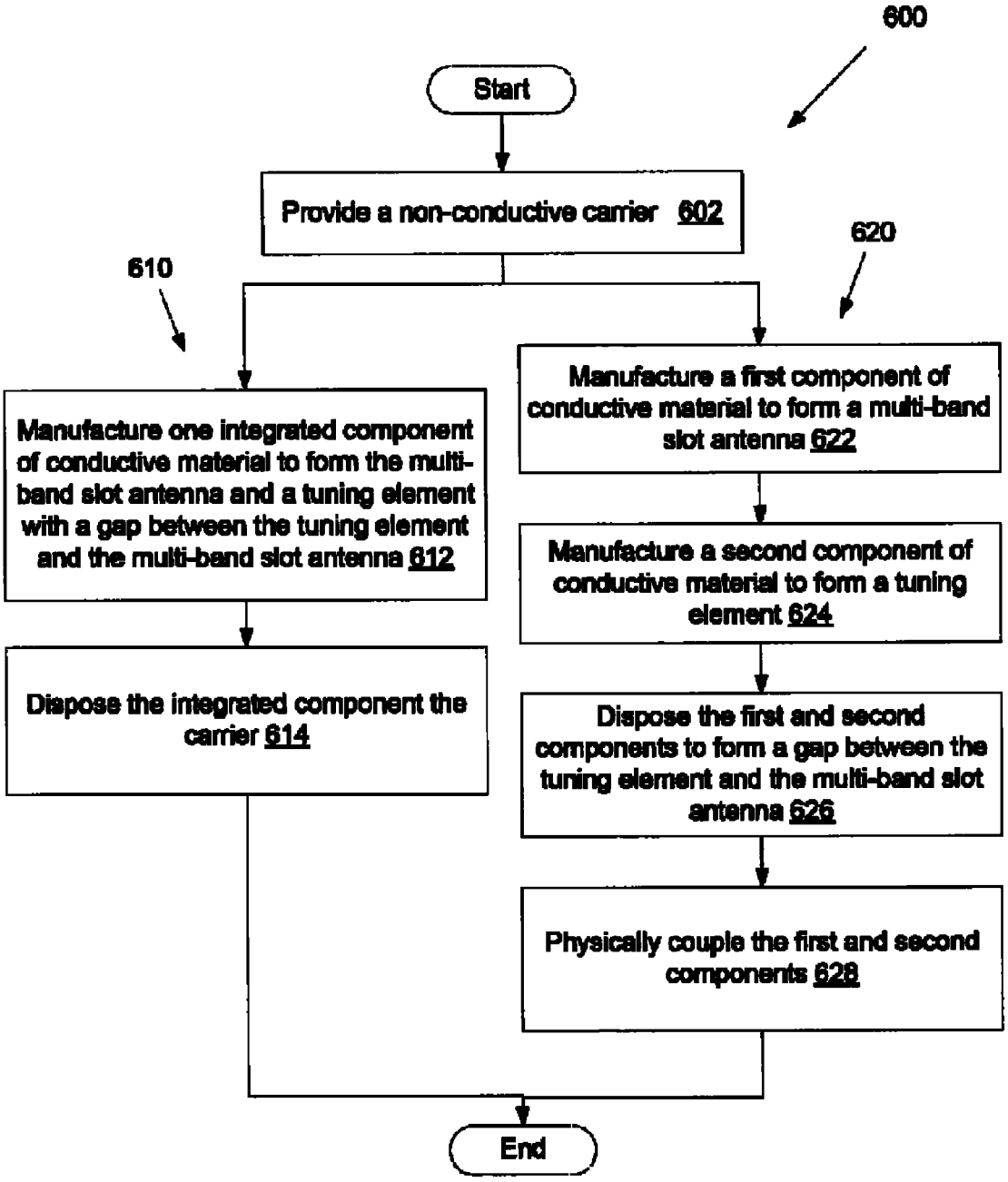
FIG. 6A is a flow diagram of an embodiment of a method of manufacturing a user device having a multi-band slot antenna and a tuning element according to one embodiment.

FIG. 6A is a flow diagram of an embodiment of a method 600 of manufacturing a user device having a multi-band slot antenna and a tuning element according to one embodiment. In method 600, a non-conductive carrier (e.g., dielectric carrier 302) is provided at block 602. The non-conductive carrier may be any non-conductive material of the user device upon which the conductive material of the multi-band slot antenna and the tuning element can be disposed without making electrical contact with other metal of the user device, such as a support member or a substrate. Next, conductive material is disposed on the non-conductive carrier to form a multi-band slot antenna, having multiple slot openings in the conductive material (e.g., multi-band slot antenna 110, 410, 510), and a tuning element. This may be done by fabricating the multi-band slot antenna and tuning element as one integrated component in process 610 or by fabricating them as separate components in process 620.

In the embodiment of process 610, the multi-band slot antenna and a tuning element are fabricated as one integrated component of conductive material at block 612. For example, portions of the conductive material can be removed to form the multiple slot openings of the multi-band slot antenna and/or the tuning element. The one integrated component is fabricated to have a gap between the tuning element and the multi-band slot antenna. Once the integrated component has been fabricated, the integrated component is disposed on the non-conductive carrier at block 614, and the process ends. In another embodiment, conductive material can be disposed on the non-conductive carrier and then portions of the conductive material can be removed to form the multi-band slot antenna and/or the tuning element (subtractive technique) to form the appropriate shape of the integrated component. Alternatively, the conductive material can be disposed on the non-conductive carrier (additive technique) to form the appropriate shape of the integrated component.

In one embodiment, the tuning element is a director. In another embodiment, the tuning element is a reflector.

In the embodiment of process 620, a first component of conductive material is fabricated to form the multi-band slot antenna at block 622, and a second component of conductive material is fabricated to form the tuning element at block 624. The first and second components are disposed on the non-conductive carrier to form a gap between the tuning element and the multi-band slot antenna at block 626, and the first and second components are physically coupled at block 628. In one embodiment, the tuning element is a director. In another embodiment, the tuning element is a reflector.

It should be noted that the first and second components can be physically coupled before or after being disposed on the non-conductive carrier at block 626. In one embodiment, the first and second components are physically coupled using one or more connectors, such as circuit traces, wires, or other conductive material. In another embodiment, the first and second components are physically coupled to a feed line connector (e.g., feed line connector 302), such as described in the embodiment above where the feed line connector 302 is coupled to the multi-band slot antenna at the back side and to the director at the front side. Alternatively, the multi-band slot antenna and the tuning element are not physically coupled.

In another embodiment, the integrated component is flexible material that can be wrapped around a top end of the non-conductive carrier such that a first portion of the conductive material is disposed on the front side of the non-conductive carrier, a second portion of the conductive material is disposed on a top side of the non-conductive carrier, and a third portion of the conductive material is disposed on a back side of the non-conductive carrier. In this embodiment, the multiple slot openings are formed in the third portion of the conductive material on the back side of the non-conductive carrier. In another embodiment, the integrated component is flexible material that can be wrapped around a top end of the non-conductive carrier such that the tuning element is disposed on the front side of the non-conductive carrier and the multi-band slot antenna is disposed on just the back side of the non-conductive carrier or on the back and top sides of the non-conductive carrier. Alternatively, the integrated component can be disposed in other locations, such as wrapped around a left or right side of the non-conductive carrier, for example. Similarly, the separate components can be disposed at block 626 in process 620 to achieve the same positioning as the integrated component in the process 610.

Figure 6B:
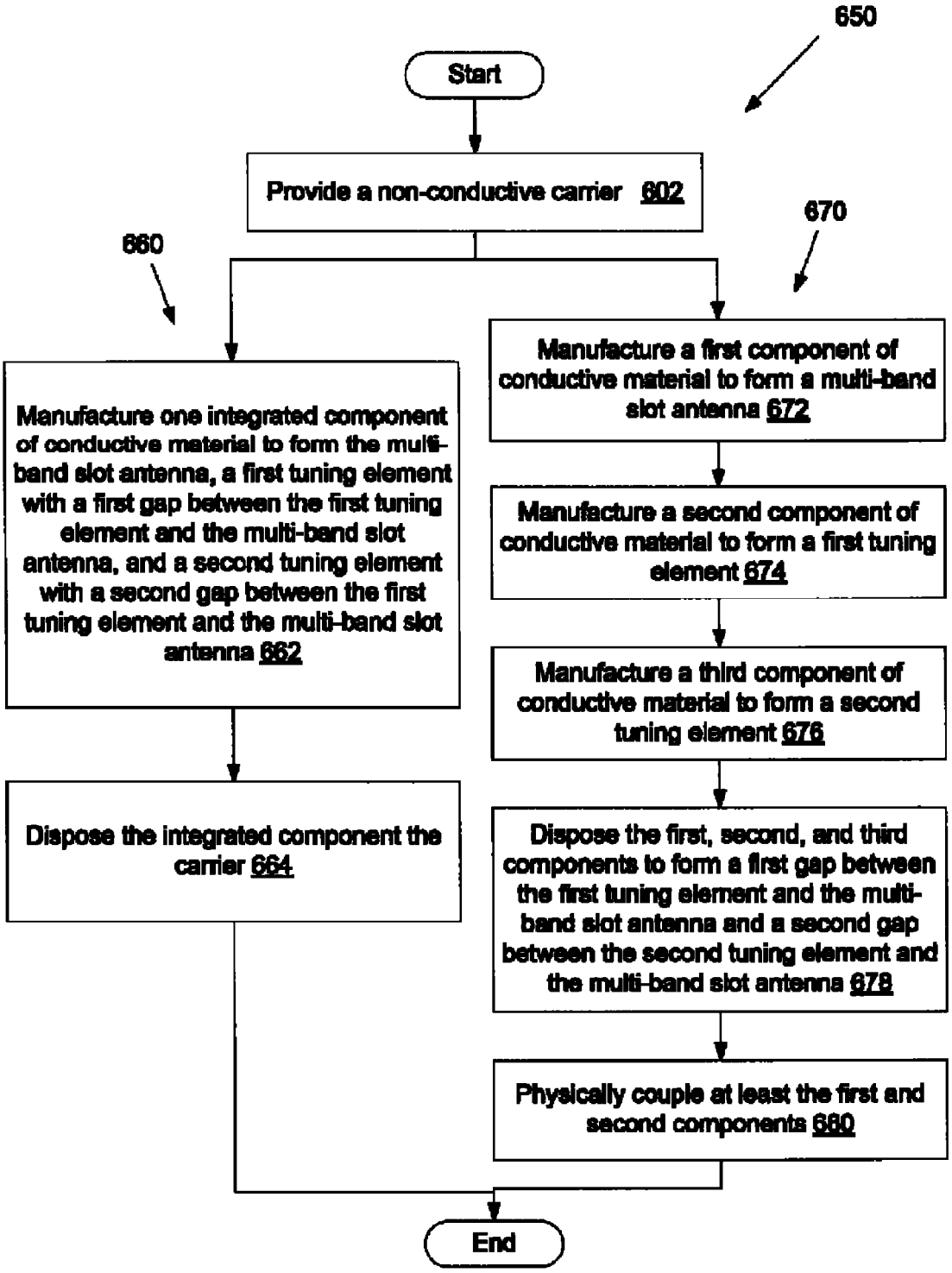
FIG. 6B is a flow diagram of an embodiment of a method of manufacturing a user device having a multi-band slot antenna and two tuning elements according to one embodiment.

FIG. 6B is a flow diagram of an embodiment of a method 650 of manufacturing a user device having a multi-band slot antenna and two tuning elements according to one embodiment. In method 650, a non-conductive carrier (e.g., dielectric carrier 302) is provided at block 652. Next, conductive material is disposed on the non-conductive carrier to form a multi-band slot antenna, having multiple slot openings in the conductive material (e.g., multi-band slot antenna 110, 410, 510), and two tuning elements. Like process 610, this may be done by fabricating the multi-band slot antenna and two tuning elements as one integrated component in process 660 or by fabricating them as separate components in process 670.

In the embodiment of process 660, the multi-band slot antenna and two tuning elements are fabricated as one integrated component of conductive material at block 662. For example, portions of the conductive material can be removed to form the multiple slot openings of the multi-band slot antenna and/or the two tuning elements. The one integrated component is fabricated to have a first gap between the first tuning element and the multi-band slot antenna and a second gap between the second tuning element and the multi-band slot antenna. Once the integrated component has been fabricated, the integrated component is disposed on the non-conductive carrier at block 664, and the process ends. In another embodiment, conductive material can be disposed on the non-conductive carrier and then portions of the conductive material can be removed to form the multi-band slot antenna and/or the two tuning elements (subtractive technique) to form the appropriate shape of the integrated component. Alternatively, the conductive material can be disposed on the non-conductive carrier (additive technique) to form the appropriate shape of the integrated component.

In one embodiment, the two tuning elements are both directors. In another embodiment, the two tuning elements are a director and a reflector. Alternatively, more than two tuning elements can be formed in the integrated component as would be appreciated by one of ordinary skill in the art having the benefit of this disclosure.

In the embodiment of process 670, a first component of conductive material is fabricated to form the multi-band slot antenna at block 672, a second component of conductive material is fabricated to form the first tuning element at block 674, and a third component of conductive material is fabricated to form the second tuning element at block 676. The first, second, and third components are disposed on the non-conductive carrier to form a first gap between the first tuning element and the multi-band slot antenna and a second gap between the second tuning element and the multi-band slot antenna at block 678, and at least the first and second components are physically coupled together at block 680. In one embodiment, the two tuning elements are both directors. In another embodiment, the two tuning elements are a director and a reflector. Alternatively, more than two tuning elements can be formed in the integrated component as would be appreciated by one of ordinary skill in the art having the benefit of this disclosure.

It should be noted that the components can be physically coupled before or after being disposed on the non-conductive carrier at block 678. In one embodiment, the components are physically coupled using one or more connectors, such as circuit traces, wires, or other conductive material. In another embodiment, the first and second components are physically coupled to a feed line connector, such as described in the embodiment above where the feed line connector 302 is coupled to the multi-band slot antenna at the back side and to the director at the front side. In another embodiment, the third component is coupled to the feed line connector. Alternatively, the third component can be physically coupled to the multi-band slot antenna using a different connector than the connector that physically coupled the first and second components.

In another embodiment, the integrated component is flexible material that can be wrapped around a top end of the non-conductive carrier such that a first portion of the conductive material is disposed on the front side of the non-conductive carrier, a second portion of the conductive material is disposed on a top side of the non-conductive carrier, and a third portion of the conductive material is disposed on a back side of the non-conductive carrier. In this embodiment, the multiple slot openings are formed in the third portion of the conductive material on the back side of the non-conductive carrier. In one embodiment, the first and second tuning elements are disposed in the first portion. In another embodiment, the first tuning element is disposed in the first portion and the second tuning element is disposed in the third portion. In another embodiment, the integrated component is wrapped around a top end of the non-conductive carrier such that the first tuning element is disposed on the front side of the non-conductive carrier and the multi-band slot antenna and the second tuning element is disposed on just the back side of the non-conductive carrier or on the back and top sides of the non-conductive carrier. Alternatively, the integrated component can be disposed in other locations, such as wrapped around a left or right side of the non-conductive carrier, for example. Similarly, the separate components can be disposed at block 678 in process 670 to achieve the same positioning as the integrated component of process 660.

In one embodiment, the method includes removing portions of the conductive material to form the multiple slot openings of the multi-band slot antenna and/or the tuning elements. This removal can occur before or after the conductive material is disposed on the non-conductive carrier in the processes described above. In one embodiment, the conductive material can be disposed on a printed circuit board during the manufacture of a printed circuit board. In another embodiment, the conductive material can be disposed on a support member within the user device, such as a support member of the display or a support member of the front or back covers of the user device's encasing. There are various techniques for disposing conductive material on printed circuit boards and other non-conductive carriers, and additional details regarding these techniques has not been included so as to not obscure the description of the present embodiments.

Figure 7:
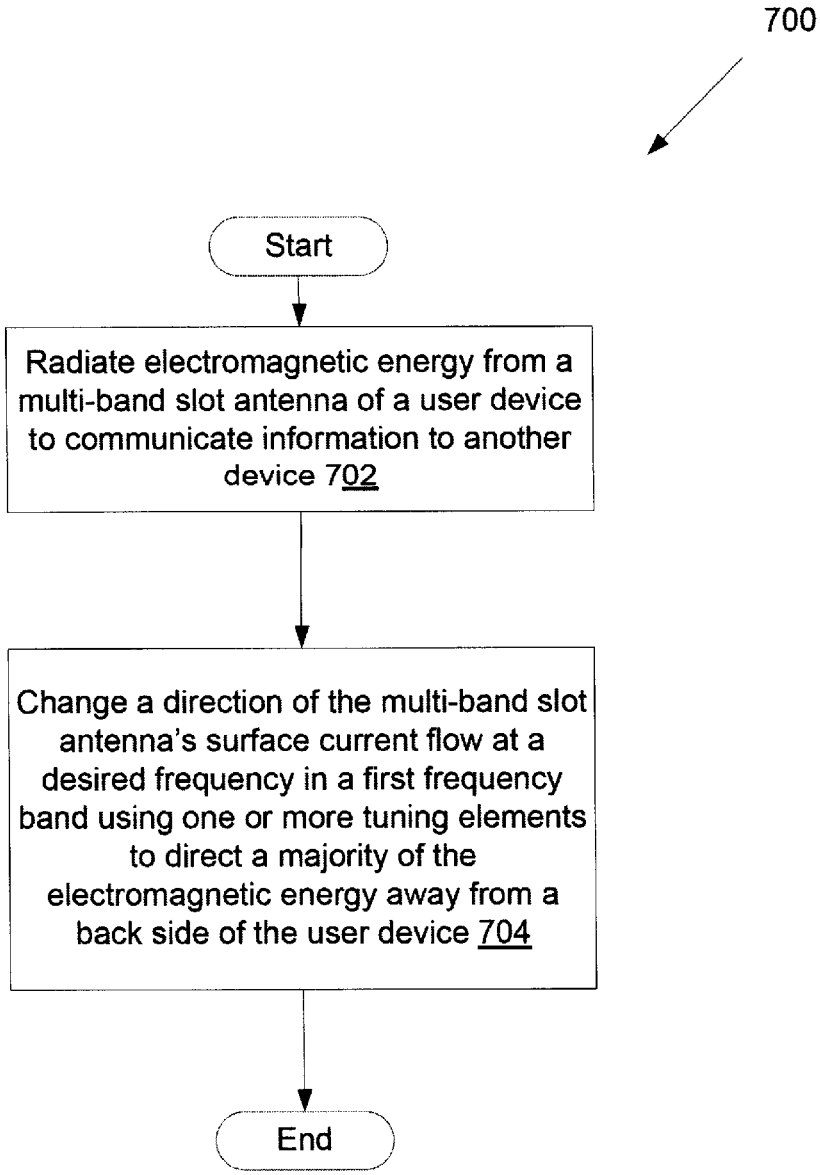
FIG. 7 is a flow diagram of an embodiment of a method of operation of a user device having a multi-band slot antenna and one or more tuning elements according to one embodiment.

FIG. 7 is a flow diagram of an embodiment of a method 700 of operation of a user device having a multi-band slot antenna and one or more tuning elements according to one embodiment. In method 700, electromagnetic energy is radiated from the multi-band slot antenna to communicate information to another device at block 702, and a direction of the multi-band slot antenna's surface current flow is changed at block 704. In particular, the surface current flow is changed at a desired frequency in a first frequency band using one or more tuning elements to direct a majority of the electromagnetic energy, radiated by the multi-band slot antenna while operating in the first frequency band, away from a back side of the user device. In one embodiment, by changing the surface current flow, the one or more tuning elements increase the electromagnetic energy radiated by the multi-band slot antenna towards the front side of the user device. In another embodiment, the one or more tuning elements both increase the electromagnetic energy radiated by the multi-band slot antenna towards the front side of the user device, and decrease the electromagnetic energy radiated by the multi-band slot antenna towards the back side of the user device.

In one embodiment, the one or more tuning elements attract the majority of electromagnetic energy radiated from the multi-band slot antenna towards the front side of the user device. In another embodiment, the one or more tuning elements reflect the majority of electromagnetic energy radiated from the multi-band slot antenna away from the back side of the user device. In another embodiment, the one or more tuning elements both attract the majority of electromagnetic energy towards the front side and reflect the majority of electromagnetic energy away from the back side of the user device.

In the above description, numerous details are set forth. It will be apparent, however, to one of ordinary skill in the art having the benefit of this disclosure, that embodiments of the invention may be practiced without these specific details. In some instances, well-known structures and devices are shown in block diagram form, rather than in detail, in order to avoid obscuring the description. It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A user device, comprising:

a dielectric carrier;

a multi-band slot antenna comprising a first portion of conductive material disposed on a first side of the dielectric carrier in a first plane and a second portion of conductive material disposed on a second side of the dielectric carrier in a second plane, wherein the multi-band slot antenna comprises a plurality of slot openings in the second portion of the conductive material, wherein the multi-band slot antenna is operable to radiate electromagnetic energy;

a director physically coupled to the multi-band slot antenna, wherein the director comprises additional conductive material disposed on the dielectric carrier in the first plane with a gap between the director and the first portion of the conductive material, wherein the director is operable to direct a majority of the radiated electromagnetic energy away from the user device in a first direction; and a feed line connector coupled to the multi-band slot antenna and the director, wherein the first portion of the conductive material has a first elongated shape and the director has a second elongated shape, wherein at least a portion of the second elongated shape is disposed parallel to the first elongated shape with the gap between the director and the first portion of the conductive material on the first side of the dielectric carrier.

2. The user device of claim 1, wherein the director and the multi-band slot antenna are physically coupled as two separate components, wherein the two separate components are physically coupled at the feed line connector.

3. The user device of claim 1, wherein the director and the multi-band slot antenna are physically coupled as one integrated part.

4. The user device of claim 1, wherein the dielectric carrier is a support member.

5. The user device of claim 1, wherein the dielectric carrier is a circuit board.

6. The user device of claim 1, wherein the first side of the dielectric carrier corresponds to a front side of the user device.

7. The user device of claim 6, wherein the feed line connector is coupled to the multi-band slot antenna at a second side of the dielectric carrier and coupled to the director at the first side of the dielectric carrier, wherein the feed line connector physically couples the multi-band slot antenna to the director.

8. The user device of claim 1, wherein the gap between the director and the conductive material of the multi-band slot antenna is approximately 1 millimeter.

9. The user device of claim 1, wherein the gap is a material gap.

10. The user device of claim 1, wherein the gap is an air gap.

11. The user device of claim 1, further comprising a reflector disposed on the second side of the dielectric carrier, wherein the second side of the dielectric carrier corresponds to a back side of the user device.

12. The user device of claim 11, wherein the reflector is physically coupled to the multi-band slot antenna.

13. The user device of claim 11, wherein the reflector and multi-band slot antenna are physically coupled as one integrated part.

14. The user device of claim 11, wherein reflector and multi-band slot antenna are physically coupled as two separate components.

15. The user device of claim 11, wherein the reflector is not physically coupled to the multi-band slot antenna.

16. The user device of claim 1, wherein the user device further comprises a reflector disposed on the second side of the dielectric carrier, wherein a second gap is between the reflector and the second portion.

17. The user device of claim 16, wherein the gap between the director and the first portion is between approximately 0.5 and 1.5 millimeters, and wherein the second gap between the reflector and the second portion is between approximately 0.5 and 1.5 millimeters.

18. The user device of claim 7, wherein a first slot opening of the multi-band slot antenna is disposed at a top of the user device and closer to the feed line connector than other slot openings of the plurality of slot openings of the multi-band slot antenna.

19. The user device of claim 18, wherein the first slot opening has a length of approximately half wavelength, lambda (λ)/2, where lambda (λ) is the length of one electromagnetic wave at a first frequency band at which the first slot opening operates, and the director has a length between approximately (λ)/8 and (λ)/4.

20. The user device of claim 1, wherein the user device is an electronic book reader.

21. The user device of claim 1, further comprising:

a wireless modem; and a power amplifier coupled to the wireless modem and the multi-band slot antenna.

22. A method of manufacturing a user device, the method comprising:

providing a non-conductive carrier;

disposing conductive material, with a plurality of slot openings, on the non-conductive carrier to form a multi-band slot antenna and a director with a first gap between the director and the conductive material of the multi-band slot antenna, wherein a first portion of the conductive material of the multi-band slot antenna is disposed on a first side of the non-conductive carrier in a first plane and the conductive material of the director is disposed on the first side of the non-conductive carrier in the first plane with the first gap between the director and the first portion of the conductive material, wherein a second portion of the conductive material of the multi-band slot antenna is disposed on a second side of the non-conductive carrier in a second plane, wherein the multi-band slot antenna is operable to radiate electromagnetic energy, and wherein the director is operable to direct a majority of the radiated electromagnetic energy away from the user device in a first direction, wherein the first portion of the conductive material has a first elongated shape and the director has a second elongated shape, wherein at least a portion of the second elongated shape is disposed parallel to the first elongated shape with the gap between the director and the first portion of the conductive material on the first side of the non-conductive carrier; and coupling a feed line connector to the multi-band slot antenna and the director.

23. The method of claim 22, further comprising fabricating one integrated component of conductive material to form the multi-band slot antenna and the director, wherein the director and multi-band slot antenna are physically coupled as the one integrated component with the first gap between the director and the multi-band slot antenna.

24. The method of claim 23, wherein said disposing the conductive material further comprises wrapping the conductive material around a first end of the non-conductive carrier such that the first portion of the conductive material is disposed on the first side of the non-conductive carrier, the second portion of the conductive material is disposed on the second side of the non-conductive carrier, and a third portion of the conductive material is disposed on a third side of the non-conductive carrier, and wherein the plurality of slot openings are formed in the second portion of the conductive material.

25. The method of claim 22, further comprising:

fabricating a first component of conductive material to form the multi-band slot antenna;

fabricating a second component of conductive material to form the director; and physically coupling the first and second components, wherein the first and second components are disposed on the non-conductive carrier such that the first and second components have the first gap between the director and the multi-band slot antenna.

26. The method of claim 22, wherein said disposing the conductive material comprises disposing additional conductive material to form a reflector on the non-conductive carrier with a second gap between the reflector and the multi-band slot antenna.

27. The method of claim 22, further comprising removing portions of the conductive material to form the plurality of slot openings of the multi-band slot antenna.

28. A method, comprising:

radiating electromagnetic energy from a multi-band slot antenna of a user device to communicate information to another device; and changing a direction of the multi-band slot antenna's surface current flow at a desired frequency in a first frequency band of the multi-band slot antenna using one or more tuning elements to direct a majority of the radiated electromagnetic energy away from a back side of the user device, wherein conductive material of the multi-band slot antenna is disposed at least partially on a dielectric carrier in a first plane, and wherein at least one of the one or more tuning elements is a director disposed in the first plane with a first gap between the director and a first portion of the conductive material disposed in the first plane, wherein the first portion of the conductive material has a first elongated shape and the director has a second elongated shape, wherein at least a portion of the second elongated shape is disposed parallel to the first elongated shape with the first gap between the director and the first portion of the conductive material on the first plane, and wherein the radiating the electromagnetic energy comprises applying a current to a feed line connector coupled to the multi-band slot antenna and the director.

29. The method of claim 28, wherein said changing comprises:

increasing the electromagnetic energy radiated by the multi-band slot antenna towards a front side of the user device; and decreasing the electromagnetic energy radiated by the multi-band slot antenna towards the back side of the user device.

30. The method of claim 28, wherein said changing comprises attracting the majority of electromagnetic energy radiated from the multi-band slot antenna towards a front side of the user device.

31. The method of claim 28, wherein said changing comprises reflecting the majority of electromagnetic energy radiated from the multi-band slot antenna away from the back side of the user device.

32. The method of claim 28, wherein said changing comprises:

attracting the majority of electromagnetic energy radiated from the multi-band slot antenna towards a front side of the user device; and reflecting the majority of electromagnetic energy radiated from the multi-band slot antenna away from the back side of the user device.

* * * * *